US009987514B1

(12) United States Patent
Tung

(10) Patent No.: US 9,987,514 B1
(45) Date of Patent: Jun. 5, 2018

(54) SWITCHABLY SWINGABLE SPINNING BIKE

(71) Applicant: SINGULARITY LTD., Belize (BZ)

(72) Inventor: Chia Lin Tung, Taichung (TW)

(73) Assignee: BH Asia Hong Kong Holding Co., Limited, Taichung (TW)

( * ) Notice: Subject to any disclaimer, the term of this patent is extended or adjusted under 35 U.S.C. 154(b) by 0 days. days.

(21) Appl. No.: 15/481,936

(22) Filed: Apr. 7, 2017

(30) Foreign Application Priority Data

Mar. 16, 2017 (TW) ..... 106203660 U

(51) Int. Cl.
*A63B 22/06* (2006.01)
*A63B 22/00* (2006.01)
*A63B 21/00* (2006.01)

(52) U.S. Cl.
CPC ..... *A63B 22/0015* (2013.01); *A63B 21/4034* (2015.10); *A63B 21/4035* (2015.10); *A63B 22/0605* (2013.01)

(58) Field of Classification Search
CPC ..... A63B 22/0015; A63B 21/4034; A63B 21/4035; A63B 22/0605; A63B 23/0476; A63B 22/18; A63B 23/03525; A63B 23/03516
USPC ..... 482/57
See application file for complete search history.

(56) References Cited

U.S. PATENT DOCUMENTS 6,322,480 B1 * 11/2001 Lim ..... A63B 26/003 472/103
7,326,151 B2 * 2/2008 Peterson ..... A63B 22/16 482/57
7,438,672 B1 * 10/2008 Rylander ..... A63B 22/0605 446/396
7,481,746 B2 * 1/2009 Ibarguren ..... A63B 22/0605 482/57
9,327,163 B2 * 5/2016 Lin ..... A63B 22/0605
9,498,673 B2 * 11/2016 Tung ..... A63B 22/0605
9,630,051 B2 * 4/2017 Lin ..... A63B 22/0605
9,707,443 B2 * 7/2017 Warren ..... A63B 23/0476
9,731,164 B1 * 8/2017 Tung ..... A63B 23/0476
2002/0055422 A1 * 5/2002 Airmet ..... A63B 22/16 482/61
2011/0105282 A1 * 5/2011 Pinzon ..... A63B 22/0605 482/57
2012/0071301 A1 * 3/2012 Kaylor ..... A63B 21/00058 482/57
2012/0108399 A1 * 5/2012 Irving ..... A63B 21/225 482/57
2013/0296139 A1 * 11/2013 Irving ..... A63B 21/225 482/57

(Continued)

*Primary Examiner* — Andrew S Lo
(74) *Attorney, Agent, or Firm* — Rosenberg, Klein & Lee

(57) ABSTRACT

A switchably swingable spinning bike includes a bike body and a base. The base has a pivot portion and is pivotally connected to a swinging seat of a swinging device. The swinging seat has two buffers flanking the pivot portion. The swinging seat has a switching device that includes two undeformable propping members that flank the pivot portion. Each of the propping members is slidable with respect to the swinging seat until it props between the swinging seat and the base, thereby limiting the swinging seat's pivotal swing with respect to the base, and in turn switching the bike body from a swingable state to a non-swingable state.

5 Claims, 6 Drawing Sheets

(56) References Cited

U.S. PATENT DOCUMENTS

| | | | | |
|---|---|---|---|---|
| 2014/0148312 | A1* | 5/2014 | Lo | A63B 22/0605 482/57 |
| 2015/0080191 | A1* | 3/2015 | Irving | A63B 21/015 482/57 |
| 2015/0111704 | A1* | 4/2015 | Lin | A63B 22/0605 482/57 |
| 2015/0238797 | A1* | 8/2015 | Irving | A63B 21/225 482/57 |
| 2015/0238808 | A1* | 8/2015 | Lin | A63B 22/0605 482/57 |
| 2016/0287931 | A1* | 10/2016 | Tung | A63B 22/16 |
| 2016/0325146 | A1* | 11/2016 | Shin | G06Q 50/22 |
| 2017/0136293 | A1* | 5/2017 | Caccia | A63B 22/0605 |

* cited by examiner

SWITCHABLY SWINGABLE SPINNING BIKE

BACKGROUND OF THE INVENTION

1. Technical Field

The present invention relates to exercise apparatuses, and more particularly to a spinning bike.

2. Description of Related Art

Spinning bikes are exercise apparatuses for providing exercise that simulates bicycle riding. A spinning bike stands still on a fixed site by its support for a user to pedal the pedals and take training and exercise like riding a bicycle. Since the support is fixedly installed, the whole apparatus remains still except for the operatable pedals. The existing apparatus thus fails to provide realistic cycling experience and renders the training and exercise disadvantageously monotonous.

As an improvement, swingable spinning bikes have been developed. For example, Taiwan Utility Model Patent No. M471910 discloses a device having a bike body pivotally connected to a base, so that a user can pedal and swing his/her body and make the bike body pivotally swing to the left and the right with respect to the base like he/she is riding a real bicycle. This provides realistic cycling experience and adds the training and exercise with some interest.

However, there have not been any devices combining the functions of swingable and non-swingable spinning bikes. A gym owner may have to furnish his/her gym with both types of spinning bikes to address the training needs of his/her customers, and this unavoidably raises his/her operational costs.

SUMMARY OF THE INVENTION

The primary objective of the present invention is to provide a switchably swingable spinning bike, which has a switching device that switches swingability of the spinning bike, so as to make the spinning bike more applicable.

For achieving the foregoing objective, the present invention provides a switchably swingable spinning bike, which comprises:

a bike body and a base, the base having a pivot portion;

a swinging device, comprising a swinging seat fixed to the bike body and two buffers fixed to two ends of the swinging seat, wherein the swinging seat is pivotally connected to the pivot portion of the base, and the two buffers flank the pivot portion, so that the swinging seat when pivotally swinging with respect to the base alternately presses against the buffers; and a switching device, being installed on the swinging seat and comprising two undeformable propping members that flank the pivot portion, wherein each said propping member is controllable to slide with respect to the swinging seat until it props between the swinging seat and the base, thereby limiting the swinging seat's pivotal swing with respect to the base, and in turn switching the bike body from a swingable state into a non-swingable state.

In one embodiment, the switching device further comprises a rail member fixed to the swinging seat and extending toward two ends of the swinging seat, on which rail member two mounts are provided positionally corresponding to two sides of the pivot portion, respectively, so that each said mount positionally corresponds to one said propping member, and each said mount has a rail groove for the corresponding propping member to slidably engage with the mount and slide thereon with respect to the swinging seat.

Furthermore, each said mount extends laterally and has a retaining plate atop, the retaining plate being flanked by two upright first lateral plates, each said first lateral plate being provided with one said rail groove; each said propping member having a top plate configured to be placed on the corresponding mount, and having two second lateral plates flanking the two first lateral plates of the corresponding mount, each said second lateral plate slidably engaging with the corresponding rail groove with a positioning pin, so that the propping members are allowed to be controlled to slide along the rail grooves with respect to the mounts until the top plates leave the retaining plates and the propping members fall down and prop between the swinging seat and the base, thereby limiting the swinging seat's pivotal swing with respect to the base. In addition, each said mount is slidably mounted on the rail member so as to be slidable with respect to the rail member.

In one embodiment, each said buffer is a cushion or a spring.

DETAILED DESCRIPTION OF THE INVENTION

Figure 1:
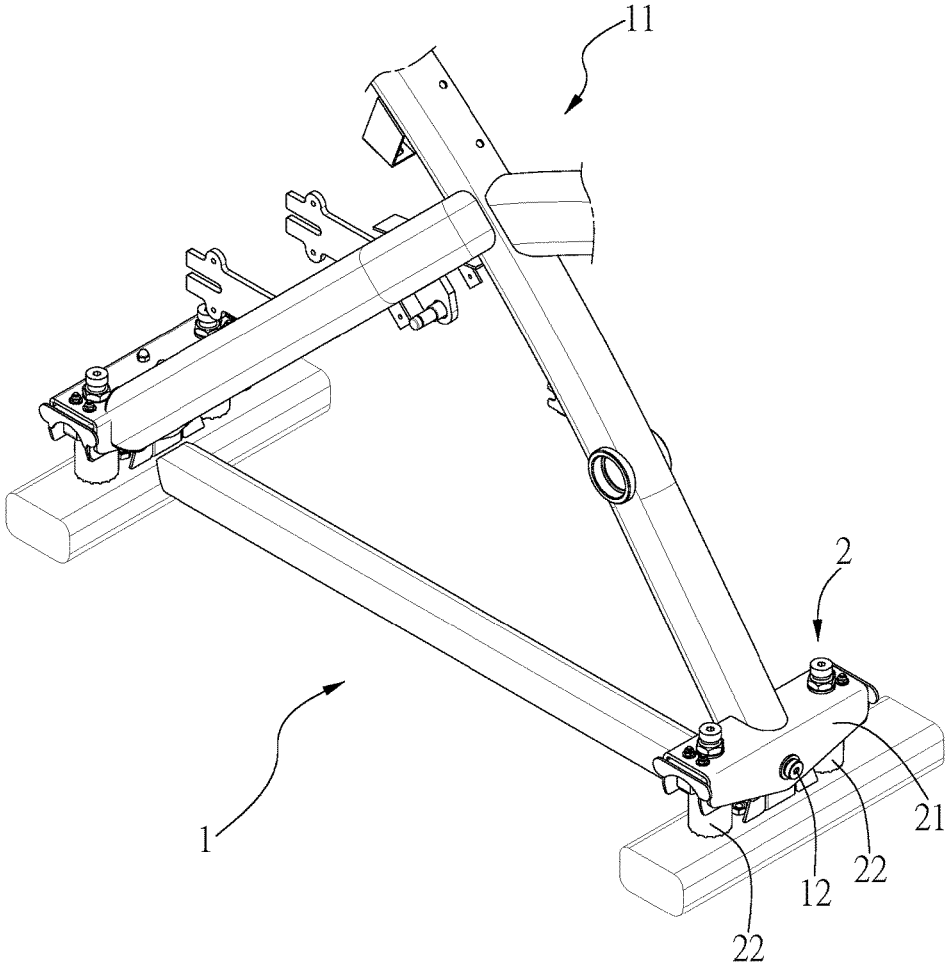
FIG. 1 is a perspective view of the present invention.
Figure 2:
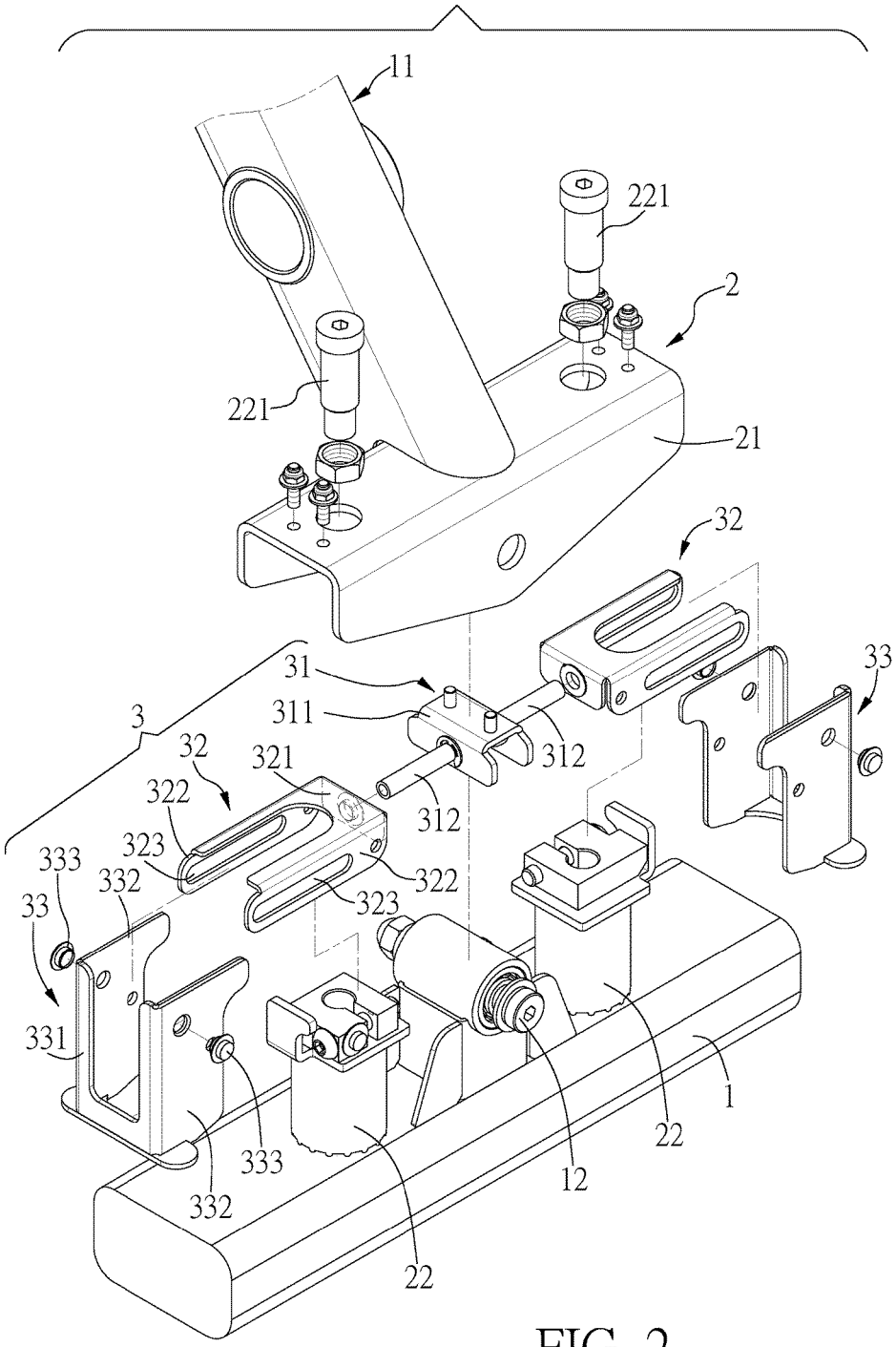
FIG. 2 is a partial, exploded view of the present invention.

Referring to FIG. 1 and FIG. 2, according to the present invention, a switchably swingable spinning bike comprises a bike body 11 and a base 1. The bike body 11 is of any common structure of spinning bikes known in the art, and primarily comprises a frame, a saddle, a handle bar, a rotatory wheel, pedals, and a damper wheel. The base 1 has its front and rear ends each provided with a pivot portion 12.

The bike body 11 is connected to the base 1 at each of its front and rear ends through a swinging device 2. The swinging device 2 has a swinging seat 21 and two buffers 22. The swinging seat 21 is fixedly connected to the bike body 11 at its one side, and is pivotally connected to a pivot portion 12 of the base 1 at the center of its opposite side, so that the bike body 11 is allowed to pivotally swing between the right and the left against the pivot portion 12 with respect to the base 1. The two buffers 22 are screwed to the swinging seat 21 through screws 221 and flank the pivot portion 12, so that the bike body 11 when pivotally swinging between the right and the left alternately presses against the buffers 22. The buffers when pressed deform to provide resilient buffering, so as to damp the pivotal swing of the bike body 11. In the present embodiment, the buffers 22 may be cushions or springs.

Each of the swinging devices 2 further has a switching device 3. The switching device 3 comprises a rail member 31. The rail member 31 is fixed to the swinging seat 21 through a stationary seat 311 and the stationary seat 311 extends a rail shaft 312 across two sides of the swinging seat 21. The rail shaft 312 is mounted with two mounts 32 corresponding to two sides of the pivot portion 12, respectively. In the present embodiment, each of the mounts 32 is slidably mounted around the rail shaft 312, so is able to slide with respect to the rail member 31.

A propping member 33 is attached to each of the mounts 32. In the present embodiment, the mount 32 extending laterally and has a retaining plate 321 atop. The retaining plate 321 is flanked by two upright first lateral plates 322. Each of the first lateral plates 322 has a laterally extending, slot-like rail groove 323. Each of the propping members 33 is made of an undeformable rigid material, and has a top plate 331 configured to be placed on the corresponding mount 32 and two second lateral plates 332 flanking the two first lateral plates 322 of the corresponding mount 32. The two second lateral plates 332 each have a positioning pin 333. The positioning pins 333 are slidably received in the rail groove 323 of the mount 32, so that the propping member 33 slidably engages with the mount 32. Thereby, the propping member 33 can be controlled to slide along the rail grooves 323 by means of the positioning pins 333, so as to slide and displace with respect to the mount 32 (in turn with respect to the swinging seat 21).

Figure 3:
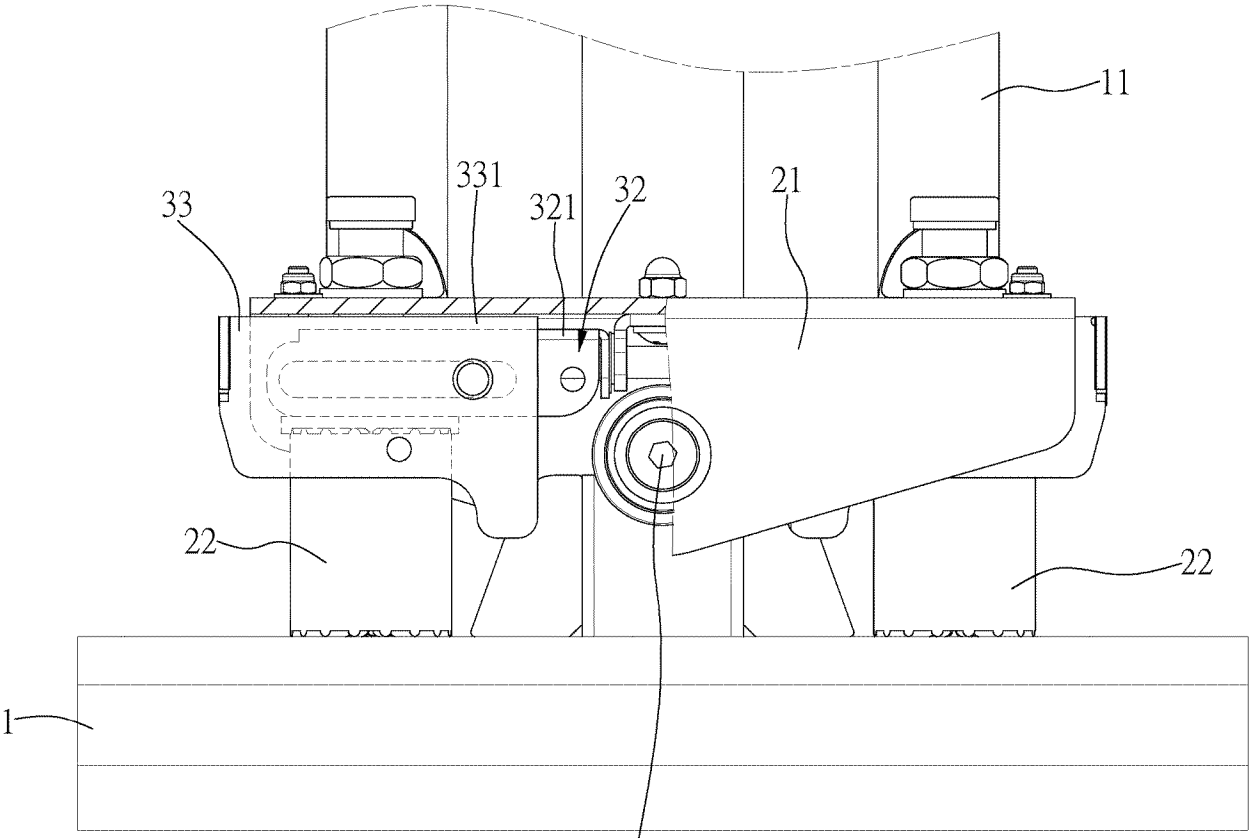
FIG. 3 is a schematic drawing showing the present invention in a swingable state.
Figure 4:
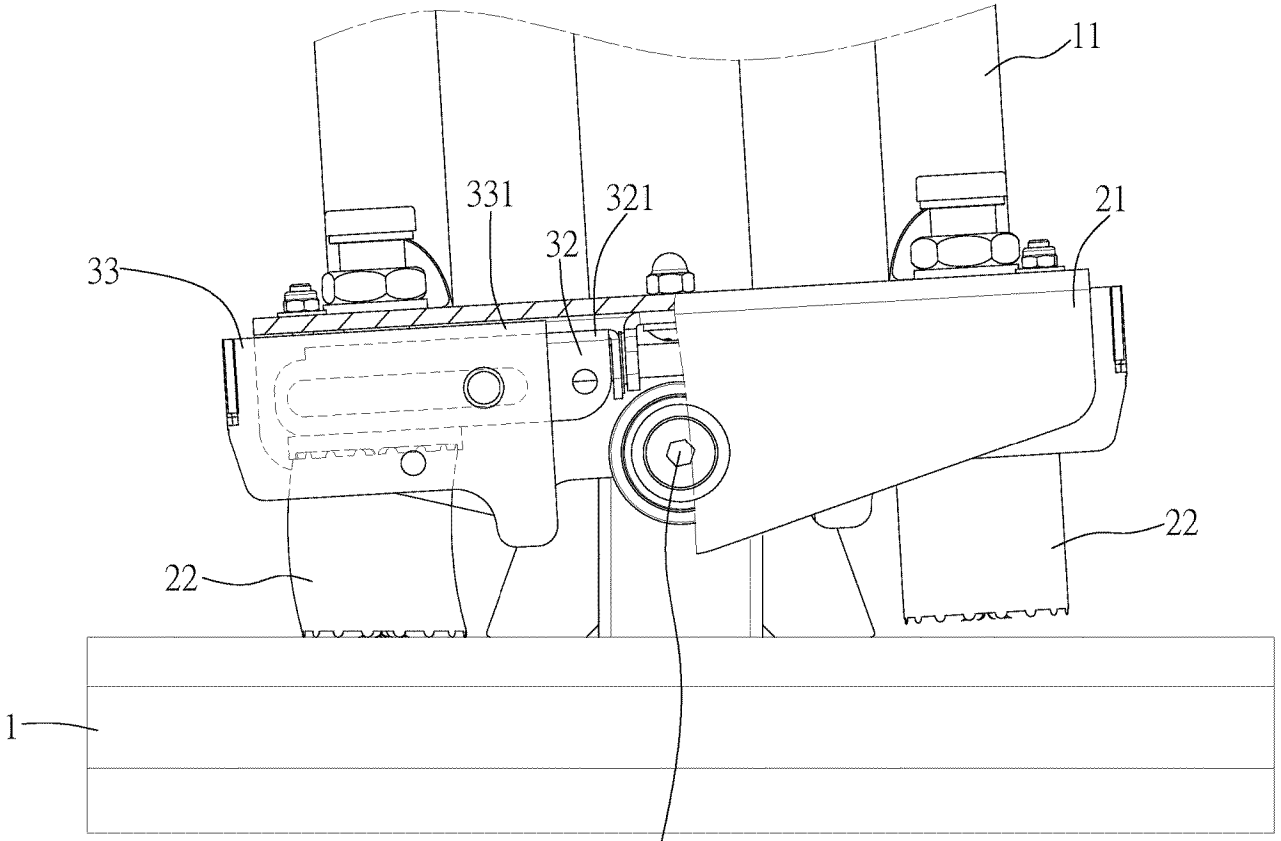
FIG. 4 is a schematic drawing showing the present invention operating in the swingable state.

With the aforementioned configuration, the present invention provides the switching device 3 that switches the bike body 11 between swingable and non-swingable states. Particularly, as shown in FIG. 3, when the propping member 33 is retracted and placed on the mount 32, the top plate 331 is stacked on the retaining plate 321 of the mount 32, so that the propping member 33 is positioned and not in contact with the base 1. At this time, the swinging seat 21 is not limited and pivotable with respect to the base 1, thereby allowing a user to operate and control the bike body 11 to pivotally swing to the left and the right. When the bike body 11 pivotally swings, the buffers 22 alternately receive force and deform accordingly as shown in FIG. 4, thereby providing resilience that returns them to the original shape as buffering means.

Figure 5:
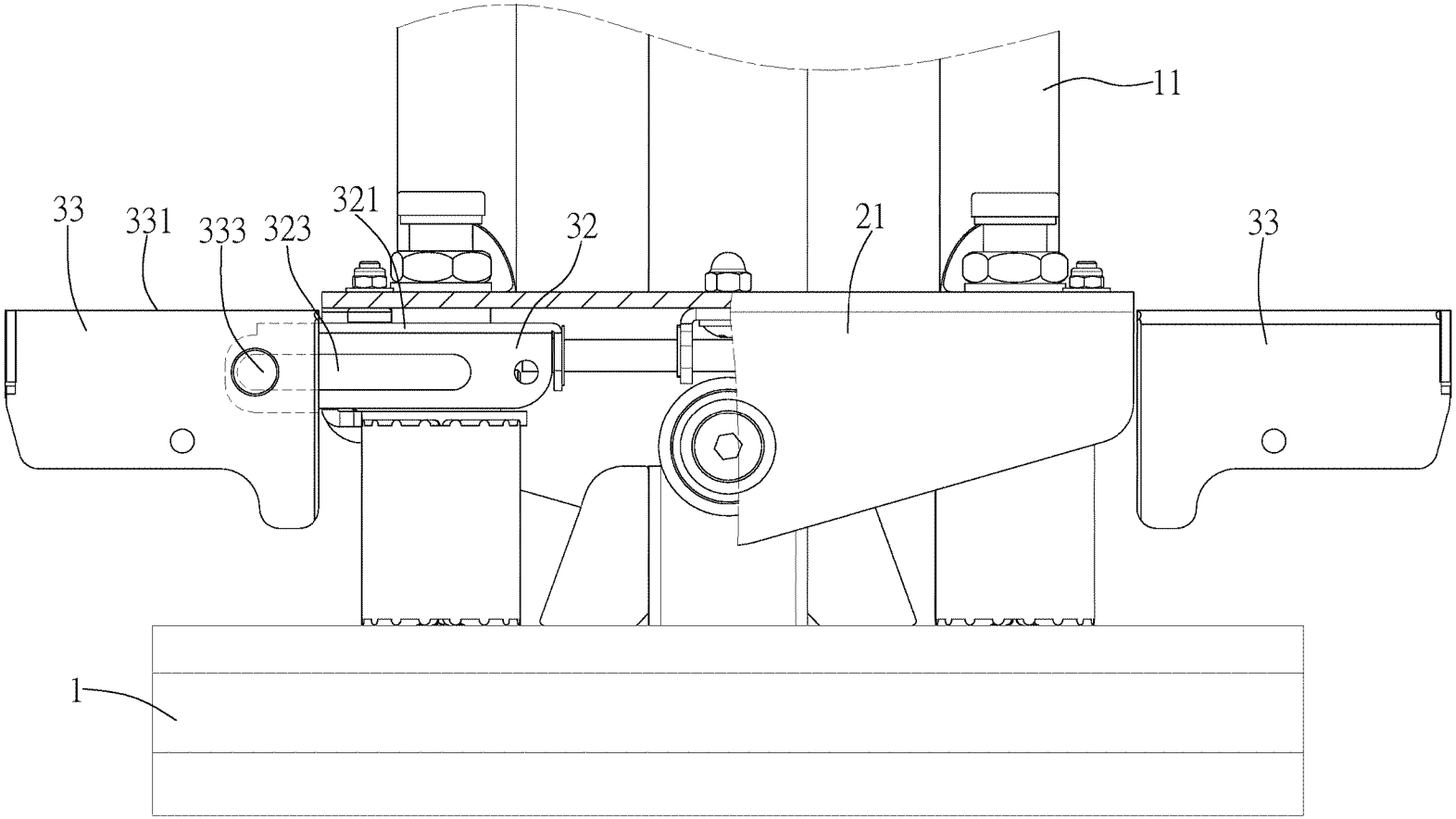
FIG. 5 and FIG. 6 are schematic drawing showing the present invention switched into a non-swingable state.
Figure 6:
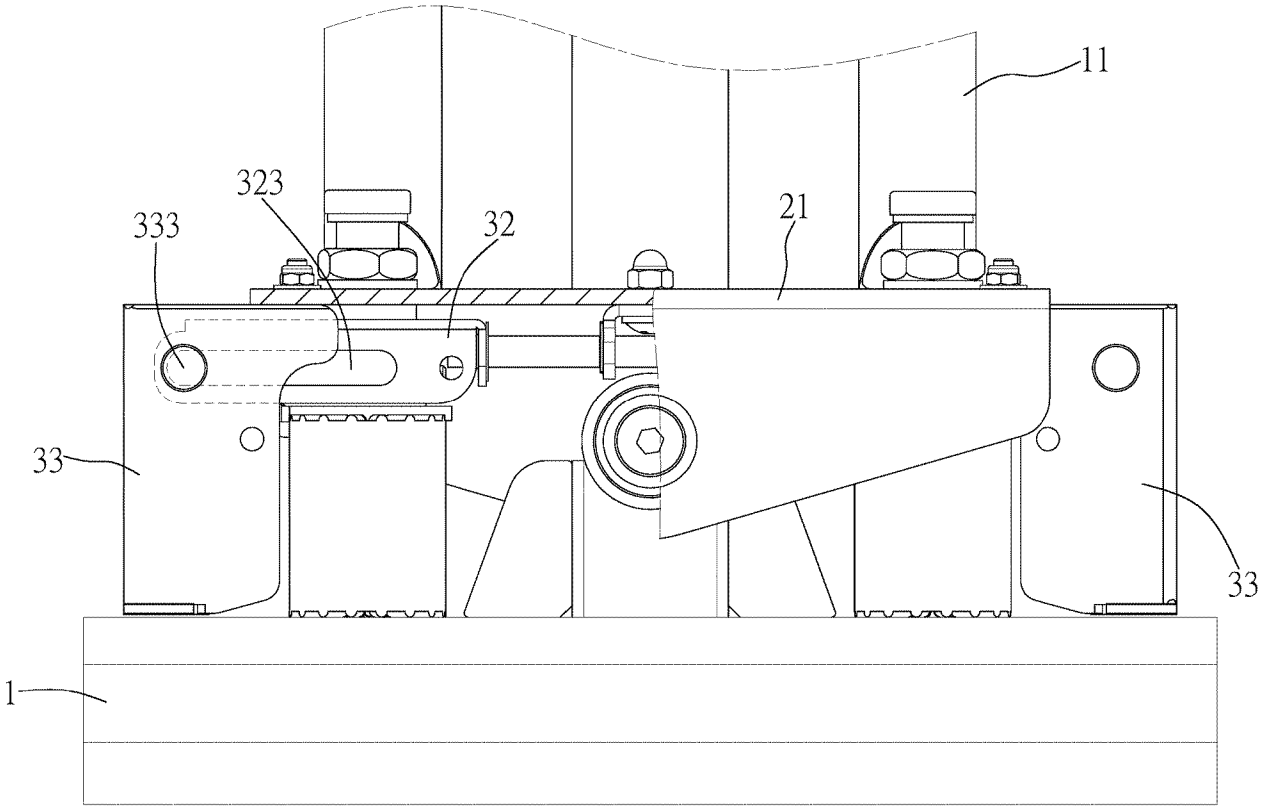

For switching the bike body 11 into the non-swingable state, as shown in FIG. 5, a user pulls the propping members 33 to slide their positioning pins 333 in the rail grooves 323 of the mounts 32, so as to laterally pull the propping members 33 out of the swinging seats 21. As a result, the top plate 331 each of the propping members 33 leaves the retaining plate 321 of the corresponding mount 32, and the propping members 33 fall down by gravity due to loss of support, as shown in FIG. 6. In the present embodiment, the mounts 32 may be alternatively pulled outside the swinging seat 21 until the propping members 33 completely become outside the swinging seat 21, so as to facilitate the propping members 33 pivoting and falling down. In this state, each of the propping members 33 has its two ends propping against the swinging seat 21 and the base 1, respectively. Since the propping members 33 do not deform even when receiving pressing force, they limit the swinging seat 21 from swing, and in turn prevent the bike body 11 from swing with respect to the base 1.

It is thus clear from the above that the present invention is advantageous for it provides a single bike body 11 having swingable and non-swingable states that can be easily switched using the switching device 3, thereby maximizing functionality of the present invention. In addition, the present invention can satisfy various users with different preferences, thus being economically beneficial.

What is claimed is:

1. A switchably swingable spinning bike, comprising:

a bike body and a base, the base having a pivot portion;

a swinging device, comprising a swinging seat fixed to the bike body and two buffers fixed to two ends of the swinging seat, wherein the swinging seat is pivotally connected to the pivot portion of the base, and the two buffers flank the pivot portion, so that the swinging seat when pivotally swinging with respect to the base alternately presses against the buffers; and a switching device, being installed on the swinging seat and comprising two undeformable propping members that flank the pivot portion, wherein each said propping member is controllable to slide with respect to the swinging seat until it props between the swinging seat and the base, thereby limiting the swinging seat's pivotal swing with respect to the base, and in turn switching the bike body from a swingable state into a non-swingable state.

2. The switchably swingable spinning bike of claim 1, wherein the switching device further comprises a rail member fixed to the swinging seat and extending toward two ends of the swinging seat, on which two mounts are provided on the rail member, and the two ends of the swinging seat positionally correspond to two sides of the pivot portion, respectively, so that each said mount positionally corresponds to one said propping member, and each said mount has a rail groove for the corresponding propping member to slidably engage with the mount and slide thereon with respect to the swinging seat.

3. The switchably swingable spinning bike of claim 2, wherein each said mount extends laterally and has a retaining plate atop, the retaining plate being flanked by two upright first lateral plates, each said first lateral plate being provided with one said rail groove; each said propping member having a top plate configured to be placed on the corresponding mount, and having two second lateral plates flanking the two first lateral plates of the corresponding mount, each said second lateral plate slidably engaging with the corresponding rail groove with a positioning pin, so that the propping members are allowed to be controlled to slide along the rail grooves with respect to the mounts until the top plates leave the retaining plates and the propping members fall down and prop between the swinging seat and the base, thereby limiting the swinging seat's pivotal swing with respect to the base.

4. The switchably swingable spinning bike of claim 3, wherein each said mount is slidably mounted on the rail member so as to be slidable with respect to the rail member.

5. The switchably swingable spinning bike of claim 1, wherein each said buffer is a cushion or a spring.

* * * * *